United States Patent [19]

Smith et al.

[11] Patent Number: 5,060,990

[45] Date of Patent: Oct. 29, 1991

[54] MULTI-STAGE DOOR SNAP

[75] Inventors: Mark A. Smith; David L. Smith; Tom B. Lindberg, all of Corvallis, Oreg.

[73] Assignee: Hewlett-Packard Company, Palo Alto, Calif.

[21] Appl. No.: 653,568

[22] Filed: Feb. 8, 1991

[51] Int. Cl.[5] ..... E05C 11/00

[52] U.S. Cl. ..... 292/91; 292/DIG. 38; 364/708

[58] Field of Search ..... 292/DIG. 38, 76, 91, 292/17, 19, 80, 87; 312/208; 364/708; 29/526

[56] References Cited

U.S. PATENT DOCUMENTS

| | | | |
|---|---|---|---|
| 4,216,984 | 8/1980 | Hofmann et al. | 292/91 |
| 4,669,053 | 5/1987 | Krenz | 364/708 |
| 4,742,478 | 5/1988 | Nigro, Jr. et al. | 312/208 X |

*Primary Examiner*—Richard E. Moore

[57] ABSTRACT

A door latch mechanism, such as for a calculator battery enclosure, has a pair of ridge and groove mating points. The mechanism has a partially engaged position in which only a single ridge engages a groove and a fully engaged position in which both ridges engage grooves. A shock to the calculator, such as by dropping it, will generally not release the mechanism to a disengaged position. Consequently, the batteries will be retained and memory functions thereby preserved.

11 Claims, 5 Drawing Sheets

MULTI-STAGE DOOR SNAP

TECHNICAL FIELD

This invention relates to latching mechanisms, and more particularly to latching mechanisms useful for securing removable access doors to hand-held electronic instruments.

BACKGROUND OF THE ART

Removable access doors find numerous applications in instruments, the most common of which are as covers to battery compartments. A latching mechanism used to secure such doors in place typically employs a flexible latching tab having a single protrusion which engages a corresponding recess in the instrument body. However, this type of mechanism will commonly disengage if the instrument is dropped, permitting the door and the batteries to be inconveniently scattered and possibly damaged.

If improved resistance to unwanted opening is desired, the spring force of the latch can be increased. However, this results in an undesirable increase in the typical force required for a user to manually disengage the latch. Consequently, it becomes difficult or impossible for some users to open the enclosure. In addition, the shock impulse caused by a dropped instrument hitting the floor is often sufficient to disengage even a latch with a high spring force.

For added security, some enclosures employ fasteners such as screws to ensure that the enclosure is not inadvertently opened. This has the disadvantage, however, of requiring the use of tools to open the compartment. Further, the fasteners are of a very small size and easily may be lost.

From the foregoing it will be recognized that there is a need for a door latching mechanism that overcomes these drawbacks of the prior art. The present invention satisfies this need.

The foregoing and additional features and advantages of the present invention will be more readily apparent from the following detailed description, which proceeds with reference to the accompanying drawings.

DETAILED DESCRIPTION OF A PREFERRED EMBODIMENT

For expository convenience, the present invention is described with reference to a battery compartment door on an electronic calculator 10. It will be recognized however, that the invention is not so limited.

Basically speaking, the illustrated embodiment of the present invention includes a door with two latched positions. In the first, a fully engaged position, the door is engaged to the body of the calculator at more than one point on a latch. In the second, a partially engaged position, the door is engaged to the body of the calculator at a single point. The latch has a third position in which it is fully disengaged from the body of the calculator.

Figure 1:
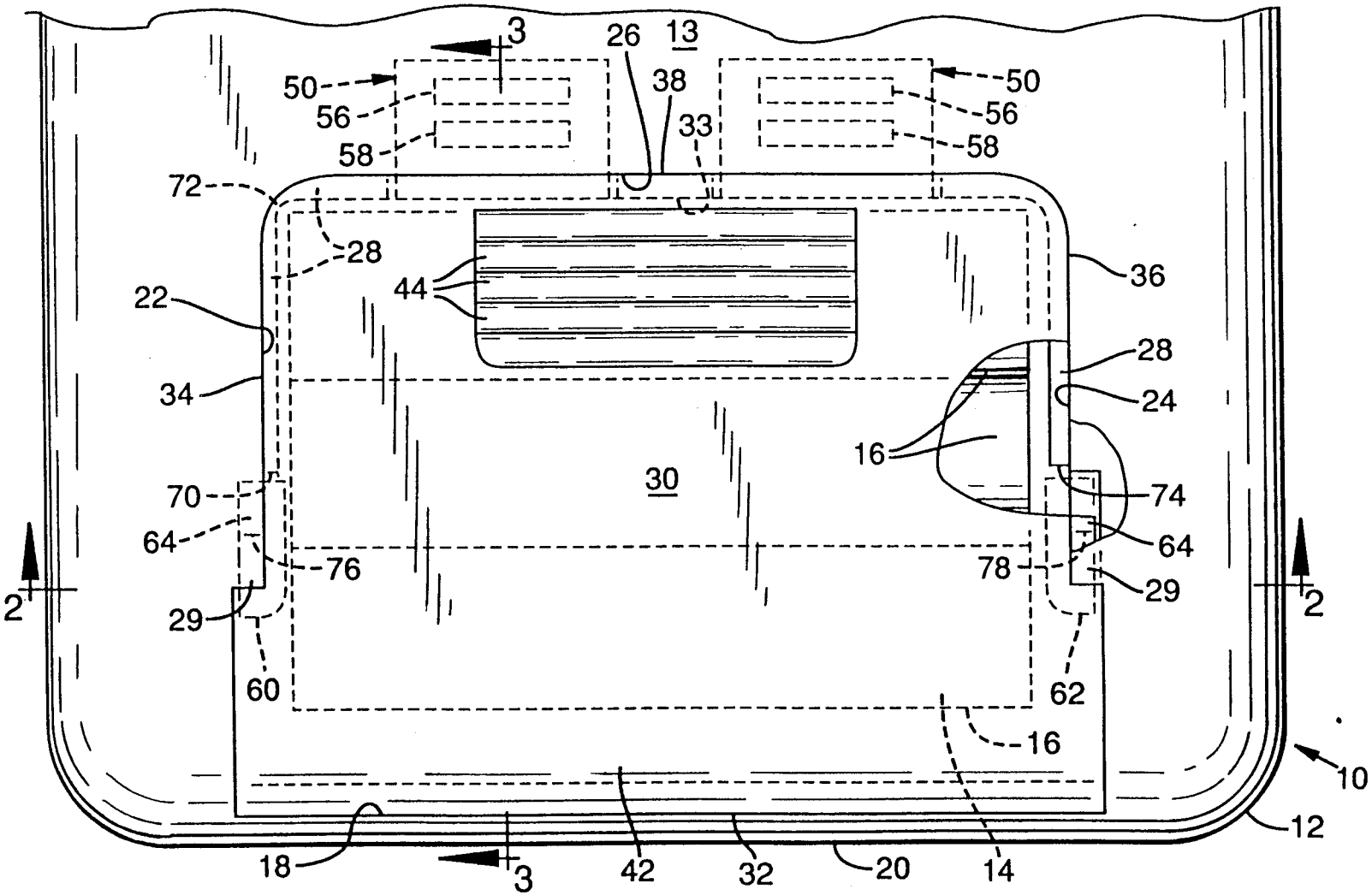
FIG. 1 is a cutaway plan view of an apparatus according to the present invention.
Figure 3:
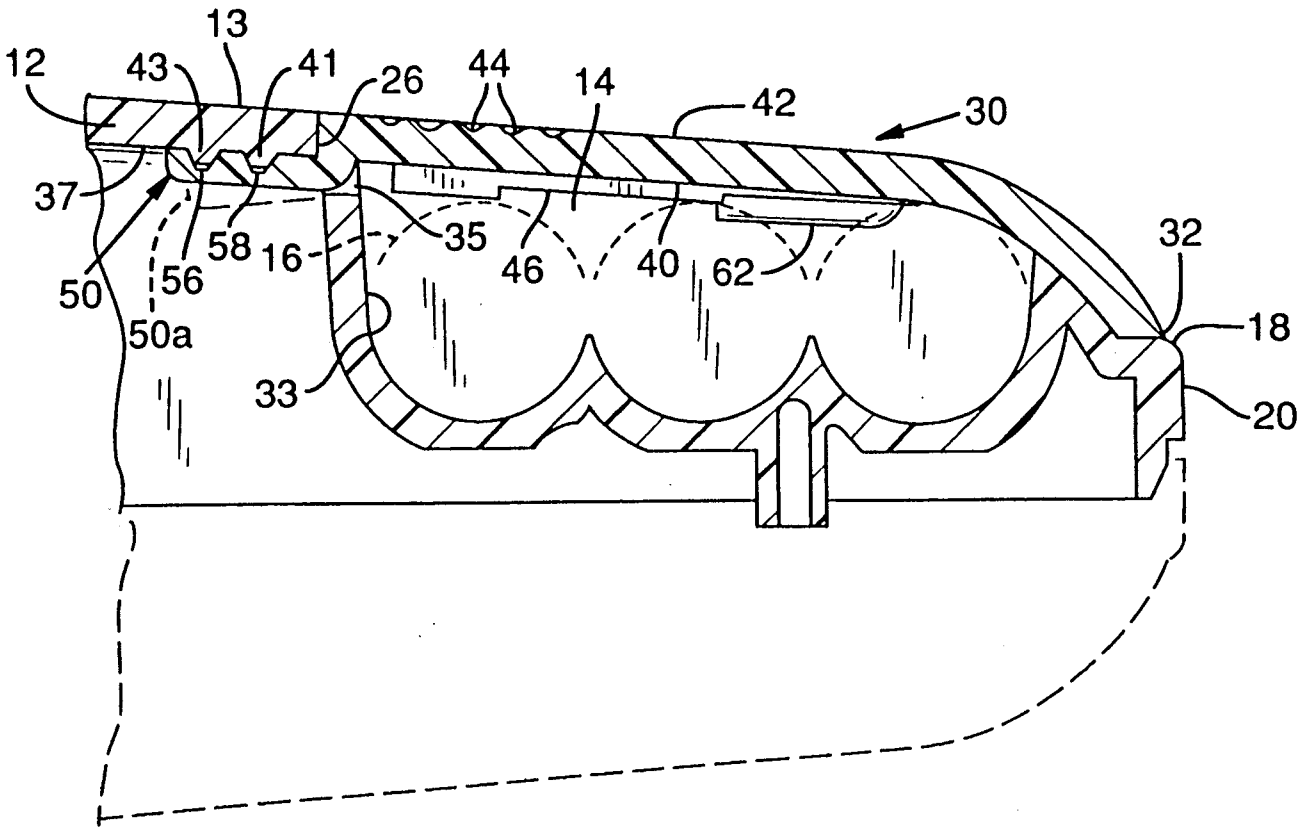
FIG. 3 is a sectional side view of the apparatus of FIG. 1.

Referring now to the drawings, FIG. 1 illustrates a portion of the calculator 10 incorporating a latching mechanism according to the present invention. The calculator has a resilient injection-molded thermoplastic body or case 12, having a case surface 13 which defines a generally rectangular battery compartment 14 that is sized and configured to hold three side-by-side cylindrically-shaped batteries 16 (FIG. 3).

The battery compartment 14 has a lower edge 18 positioned parallel to and proximate to a lower end 20 of the calculator, and further has first and second parallel side edges 22, 24 on opposite sides of the compartment 14. These side edges are adjacent to and generally perpendicular to the lower edge of the compartment. The compartment 14 also has an upper side 26 opposite the lower side of the compartment.

The compartment 14 further has a peripheral ledge 28 located in a plane parallel to and spaced below the case surface 13. The ledge extends about approximately one half of the perimeter of the compartment. The ledge runs from an approximate mid point 70 of the first side 22 to a corner 72 of the compartment where the first side and the upper side 26 meet. The ledge continues along the upper side to the second side 24, and further continues to an approximate mid point 74 of this second side.

Figure 2:
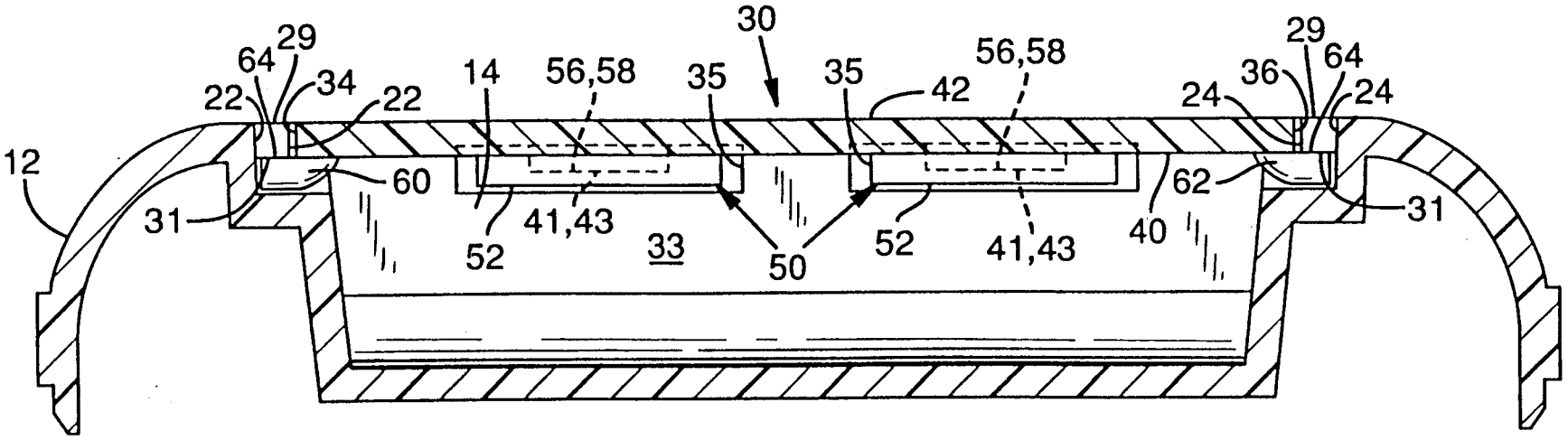
FIG. 2 is a sectional end view of the apparatus of FIG. 1.

The compartment 14 is further provided with a pair of overhangs 29, each one at intermediate positions 76, 78 on the first and second sides 22, 24 adjacent to the peripheral ledge 28 and closer to the lower side 18 of the compartment. Each overhang has a hidden surface 31, as shown in FIG. 2, which is coplanar with the ledge 28. The compartment has a rear wall 33 having a pair of spaced-apart longitudinal and rectangular tab slots 35 defined therein, the slots being oriented parallel to and slightly below the case surface 13.

Figure 9:
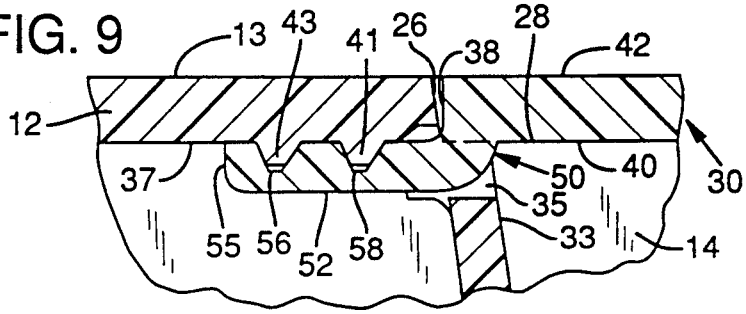
FIG. 9 is an enlarged sectional side view of the latch mechanism of FIG. 1 showing the latching tab in a fully engaged position.

The case 12 has an engagement surface 37, as shown in FIG. 3, which forms the interior surface of the case 12 and is coplanar with the peripheral ledge 28. Formed on the engagement surface 37 is a pair of engagement FIGS. 39 as shown in FIG. 9, each such figure being located in a region proximate to a respective tab slot 35. Each engagement figure comprises a pair of spaced-apart parallel ridges integrally formed with the case 12. The ridges each comprise a first engagement point or first ridge 41, and a second engagement point or second ridge 43. The ridges are parallel to the rear wall 33, each first ridge being nearer to the tab slot 35. Where a plurality of engagement figures are provided, the first ridges of such figures will cooperatively function as a single engagement point.

Figure 4:
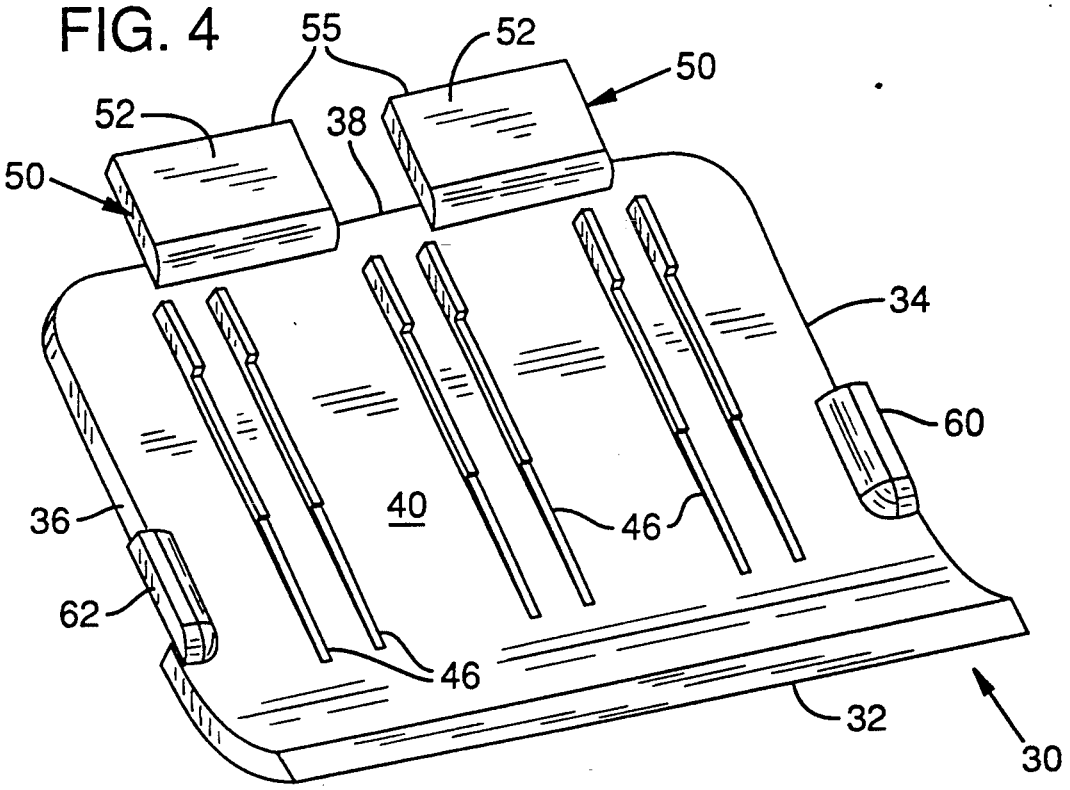
FIG. 4 is an isometric view of the inner side of the door employed in the apparatus of FIG. 1.
Figure 5:
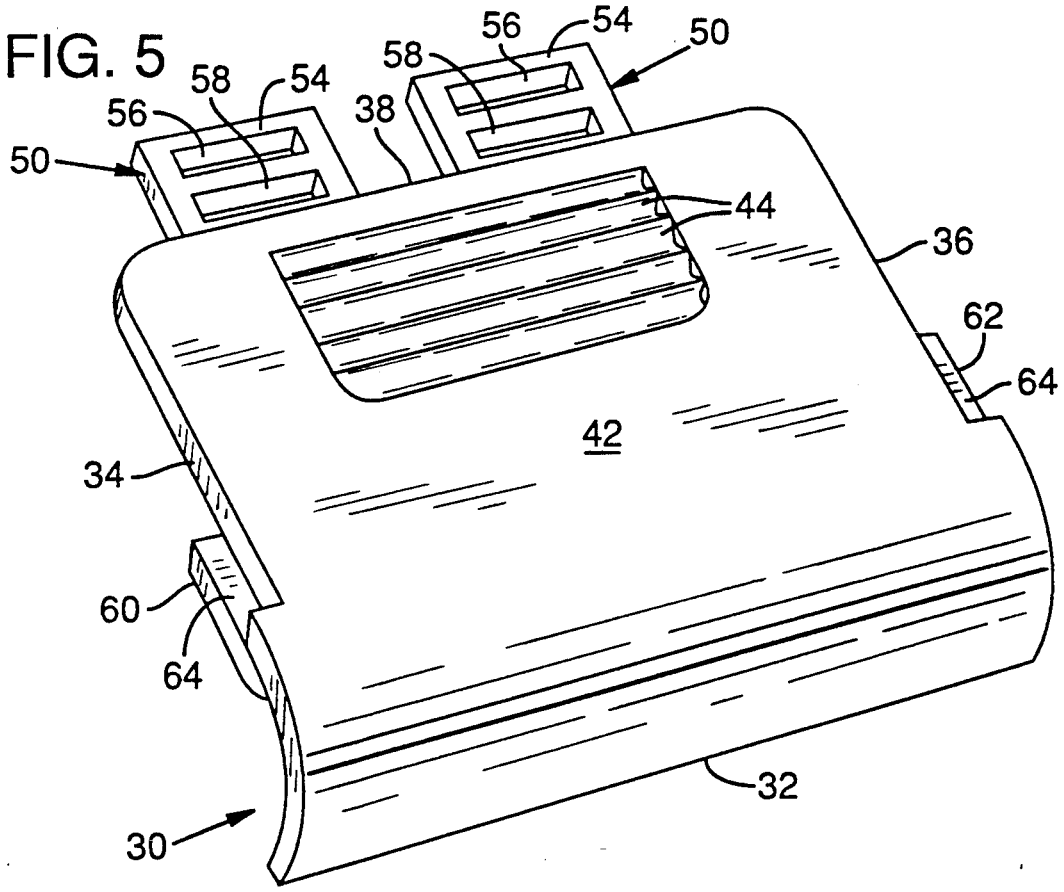
FIG. 5 is an isometric view of the outer side of the door employed in the apparatus of FIG. 1.

The calculator 10 is provided with a removable sliding door 30 made of a resilient thermoplastic material similar to that of the case 12. As illustrated in FIGS. 4 and 5, the door 30 has a generally rectangular shape which is sized and configured to fit generally within and to fully enclose the battery compartment 14. The sliding door has a lower edge 32, a first side edge 34, a second side edge 36 and an upper edge 38, the lower edge 32 corresponding to the lower side 18 of the battery compartment, the first side edge 34 corresponding to the first side 22 of the battery compartment, the second side edge 36 corresponding to the second side 24 of the battery compartment, and the upper edge 38 corresponding to the upper side 26 of the battery compartment. The sliding door has an inner surface 40 and an outer surface 42, the outer surface being contoured similarly to the case surface !3. The inner surface is generally parallel to and spaced apart from the outer surface by a distance equal to the distance by which the peripheral ledge 28 of the compartment 14 is spaced below the case surface 13. The outer surface is thereby made flush with the case surface when the peripheral edges of the inner surface engage the peripheral ledge of the compartment and when the sliding door is positioned in the battery compartment 14.

The outer surface 42 of the door 30 is provided with a plurality of recessed grooves 44 which occupy a rectangular region proximate to the upper edge 38. The grooves are oriented parallel to the upper edge so that manual force applied downwardly by a thumb or finger of a user to the outer surface at the recessed grooves and laterally in a direction toward the lower edge 32 of the sliding door will cause the door to move in a direction toward its lower edge 32 without the user's finger slipping on the grooves. The inner surface 42 of the door is provided with a plurality of reinforcing ribs 46 which provide the door with increased rigidity, the ribs being perpendicular to the lower edge of the door.

The door 30 is further provided with a pair of spaced-apart, rectangular and planar latching tabs 50 integrally attached to the upper edge of the door and extending distally therefrom at locations to align with the tab slots 35 in the rear wall 33 of the compartment 14, the tabs being sized to pass therethrough. The latching tabs each have an inner face 52 and an outer face 54. The outer face is coplanar with the inner surface 40 of the door 30 and is closely parallel to the engagement surface 37 of the case 12. The inner face is parallel to the outer face and is more distally removed from the outer surface 42 of the door. Each tab has a nose end 55 distally removed from the upper edge 38 of the door 30.

Each latching tab 50 is provided with a tab FIG. 53 corresponding to a respective engagement FIG. 39 of the case 12, each tab figure comprising a first latch point or first recess 56 and a second latch point or second recess 58 formed in the outer face 54. Each recess is an elongated trough having a trapezoidal cross section, and is oriented with its length parallel to the upper edge 38 of the door 30. Each recess runs substantially across the width of the latching tab. The recesses on each tab are spaced apart by a distance equal to the distance by which the first ridge 41 and second ridge 43 are spaced apart. The recesses are configured to engage the ridges 41 and 43 of the door, each ridge and recess mating pair being an engagement point.

The sliding door is provided with a pair of guide tabs, a first guide tab 60 being positioned at the first side edge 34 of the door and a second guide tab 62 being positioned on the second side edge 36 of the door. Each guide tab is integrally fixed to the inner surface 40 of the door, and has a guide surface 64 in the plane of the inner surface 40 of the door and facing in the direction of the outer surface 42 of the door. Each guide tab extends beyond the respective side edge by a distance equal to the width of the guide surface 64. Each guide surface is positioned to slidably contact the hidden surface 31 of the compartment overhang 29 when the latching tabs 50 are partially or completely inserted in the tab slots 35.

OPERATION

Figure 6:
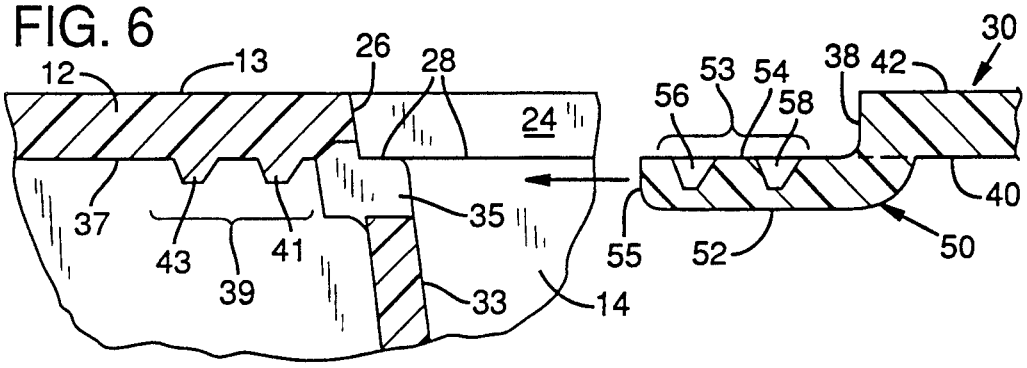
FIG. 6 is an enlarged sectional side view of the latch mechanism of FIG. 1 in a disengaged position.

As shown in FIG. 6, the door 30 is positioned with its inner surface 40 coplanar with and contacting the peripheral ledge 28. The door is advanced so that the latching tabs 50 penetrate the tab slots 35 in the rear wall 33. Although not shown in the figure, the guide tabs 60 and 62 are oriented below the overhangs 29 so that the guide surfaces 64 contact the hidden surfaces 31, thereby preventing the door from being pulled away from the compartment in a direction perpendicular to its sliding motion.

Figure 7:
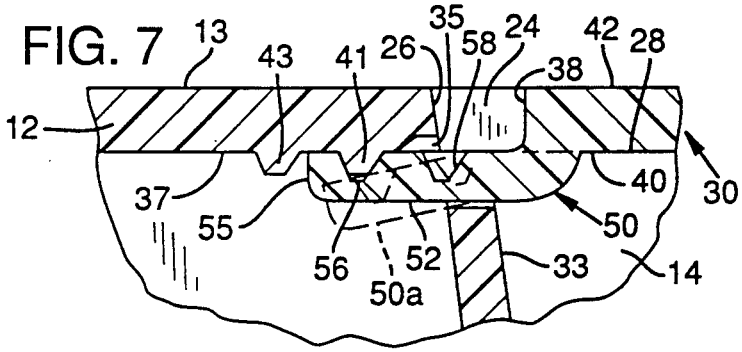
FIG. 7 is an enlarged sectional side view of the latch mechanism of FIG. 1 in a partially engaged position, and shows an intermediate position of the latching tab prior to partial engagement.

As shown in FIG. 7, the nose end 55 of the latching tab 50 encounters the first ridge 41 on the engagement surface 37, causing the latching tab to flex away from the first ridge to a flexed position 50*a* shown by dashed lines. As the door is advanced, the first recess 56 aligns with the first ridge 41 permitting the tab to extend to its original position as shown by solid lines, thereby setting the latch in a partially engaged position.

Figure 8:
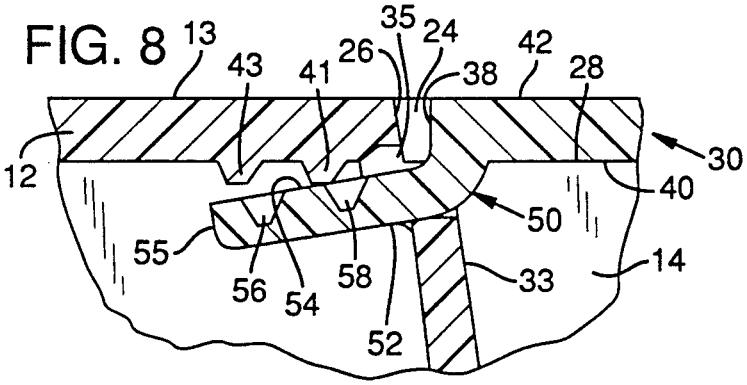
FIG. 8 is an enlarged sectional side view of the latch mechanism of FIG. 1 in an intermediate position between partial engagement and full engagement of the mechanism.

As shown in FIG. 8, latching tab flexes to permit the portion of the outer face 54 between the first recess 56 and the second recess 58 to pass over the first ridge 41. As the tab flexes, the inner face 52 encounters the rear wall 33 which acts as a fulcrum to restrain the flexing of the tab to a controlled amount.

FIG. 9 shows the latch in a fully engaged position, in which the door has been advanced sufficiently so that the first ridge 41 aligns with the second recess 58 and the second ridge 43 aligns with the first recess 56, thereby permitting the tab 50 to extend so that its outer face 54 contacts the engagement surface 37. The upper edge 38 of the door is proximate to the upper side 26 of the compartment when engagement occurs. In the fully engaged position, the compartment is entirely closed and locked and the outer surface 42 of the door is in flush alignment with the case surface 13.

To unlock and open the door, the user presses downwardly and toward the bottom of the calculator at the recessed grooves 44 with the user's finger or thumb so that the latching mechanism follows the locking steps in reverse order until the door is open and removed. The opening force will generally require two impulses, the first to bring the latch into a partially engaged position, and the second to fully disengage the latch. A single impulsive force such as that which occurs by dropping a calculator onto a hard surface will generally only partially disengage the latch so that the compartment contents will be retained and the latch need only be fully reengaged.

Having illustrated and described the principles of our invention by what is presently a preferred embodiment thereof, it should be apparent to those persons skilled in the art that the illustrated embodiment may be modified without departing from such principles. We claim as our invention not only the illustrated embodiment, but all such modifications, variations, and equivalents thereof as fall within the true spirit and scope of the following claims.

We claim:

1. A multi-stage door latch for a portable electronic instrument comprising:

a removable door having a flexibly resilient tab extending therefrom, the tab having first and second latch points;

a body having first and second engagement points, the first engagement point being configured to engage the first latch point or the second latch point, the second engagement point being configured to engage the first latch joint, whereby when any latch point is engaged by any engagement point, an application of force is required to move the door in an opening direction to separate the door from the body, such that the door generally remains secured by at least one latch point against external shocks.

2. The apparatus of claim 1 wherein the door slides longitudinally to engage the body.

3. The apparatus of claim 1 wherein the door encloses a battery compartment of an electronic instrument.

4. The apparatus of claim 1 wherein the first and second latch points are recesses defined by the tab.

5. The apparatus of claim 4 wherein the engagement points comprise raised portions of the case.

6. The apparatus of claim 4 wherein the recesses are V-shaped troughs oriented generally perpendicularly to the opening direction.

7. An apparatus for latching a sliding compartment enclosure door to a body of a hand held device, the latch having:

a fully engaged position wherein the door is engaged to the body at a plurality of engagement points;

a partially engaged position wherein the door is engaged tot he body at a single engagement point; and a disengaged position wherein the door is freely removable from the body, such that the door will generally remain at least partially engaged when the device s dropped on a hard surface.

8. The apparatus of claim 7 wherein each engagement point is a figure formed in the body and sized and configured to mate with a latch point formed in the door.

9. The apparatus of claim 8 wherein the door has a latching spring tab integrally attached to the door, the latch points being formed in the tab.

10. The apparatus of claim 8 wherein the figures forming the engagement point of the partially engaged position are also used to form the engagement points of the fully engaged position.

11. A method of latching and unlatching a removable compartment enclosure door and an electronic calculator body, the method comprising the steps of:

pushing the door into a body until a single latch is engaged;

further pushing the door until two latches are engaged, whereby the door is locked;

pulling the door from the body until only a single latch is engaged;

further pulling the door until no latch is engaged, whereby the door may be removed.

* * * * *

UNITED STATES PATENT AND TRADEMARK OFFICE

CERTIFICATE OF CORRECTION

PATENT NO. : 5,060,990

DATED : October 29, 1991

INVENTOR(S) : Mark A. Smith, et al

It is certified that error appears in the above-indentified patent and that said Letters Patent is hereby corrected as shown below:

Column 3, line 19 of the patent, delete "!3". and insert therefor --13--.

Column 5,
Claim 1, line 16 of the patent, delete "joint", and insert therefor --point--.

Column 6,
Claim 7, line 7 of the patent, delete "tot he", and insert therefor --to the--.

Signed and Sealed this

Seventeenth Day of May, 1994

*Attest:*

*Attesting Officer*

BRUCE LEHMAN

*Commissioner of Patents and Trademarks*